US010067433B2

(12) United States Patent
Haruyama

(10) Patent No.: US 10,067,433 B2
(45) Date of Patent: Sep. 4, 2018

(54) CONDUCTIVE SUPPORT, ELECTROPHOTOGRAPHIC PHOTORECEPTOR, AND PROCESS CARTRIDGE

(71) Applicant: FUJI XEROX CO., LTD., Tokyo (JP)

(72) Inventor: Daisuke Haruyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/490,454

(22) Filed: Apr. 18, 2017

(65) Prior Publication Data

US 2018/0164707 A1 Jun. 14, 2018

(30) Foreign Application Priority Data

Dec. 14, 2016 (JP) ..... 2016-242511

(51) Int. Cl.

| | |
|---|---|
| ***G03G 5/00*** | (2006.01) |
| ***G03G 5/10*** | (2006.01) |
| ***G03G 21/18*** | (2006.01) |
| ***G03G 5/06*** | (2006.01) |
| ***G03G 5/05*** | (2006.01) |
| ***G03G 5/047*** | (2006.01) |
| ***G03G 5/14*** | (2006.01) |

(52) U.S. Cl.

CPC ..... *G03G 5/102* (2013.01); *G03G 5/047* (2013.01); *G03G 5/0517* (2013.01); *G03G 5/0525* (2013.01); *G03G 5/0542* (2013.01); *G03G 5/0564* (2013.01); *G03G 5/0614* (2013.01); *G03G 5/0696* (2013.01); *G03G 5/10* (2013.01); *G03G 5/144* (2013.01); *G03G 21/18* (2013.01); *G03G 2215/00962* (2013.01)

(58) Field of Classification Search

CPC ..... G03G 5/102; G03G 5/10
USPC ..... 430/69
See application file for complete search history.

(56) References Cited

U.S. PATENT DOCUMENTS 7,897,315 B2 * 3/2011 Takemoto ..... G03G 5/102 399/159
9,217,981 B2 12/2015 Kimoto et al.

FOREIGN PATENT DOCUMENTS

JP 5663546 B2 2/2015

* cited by examiner

*Primary Examiner* — Mark A Chapman
(74) *Attorney, Agent, or Firm* — Sughrue Mion, PLLC

(57) ABSTRACT

A conductive support is formed of a bottomless hollow cylindrical member being made of metal and having a thickness t of equal to or less than 0.5 mm, the conductive support including: a chamfer portion on an outer peripheral surface side of at least one end of the conductive support over an entire circumferential direction, wherein the chamfer portion has a chamfer angle a of equal to or greater than 10° and less than 30° with respect to the outer peripheral surface, and a chamfer width b equal to or greater than 0.05 mm in an end surface, and wherein an end surface width c is equal to or greater than 0.1 mm in the end surface including the chamfer portion.

6 Claims, 5 Drawing Sheets

CONDUCTIVE SUPPORT, ELECTROPHOTOGRAPHIC PHOTORECEPTOR, AND PROCESS CARTRIDGE

CROSS-REFERENCE TO RELATED APPLICATIONS

This application is based on and claims priority under 35 USC 119 from Japanese Patent Application No. 2016-242511 filed Dec. 14, 2016.

BACKGROUND

1. Technical Field

The present invention relates to a conductive support, an electrophotographic photoreceptor, and a process cartridge.

2. Related Art

An electrophotographic photoreceptor in which at least a photosensitive layer is disposed on a conductive support is known as an electrophotographic photoreceptor which is provided in an electrophotographic image forming apparatus.

SUMMARY

According to an aspect of the invention, there is provided a conductive support which is formed of a bottomless hollow cylindrical member being made of metal and having a thickness t of equal to or less than 0.5 mm, the conductive support including:

a chamfer portion on an outer peripheral surface side of at least one end of the conductive support over an entire circumferential direction, wherein the chamfer portion has a chamfer angle a of equal to or greater than 10° and less than 30° with respect to the outer peripheral surface, and a chamfer width b of equal to or greater than 0.05 mm in an end surface, and wherein an end surface width c is equal to or greater than 0.1 mm in the end surface including the chamfer portion.

BRIEF DESCRIPTION OF THE DRAWINGS

Exemplary embodiments of the present invention will be described in detail based on the following figures, wherein.

DETAILED DESCRIPTION

Hereinafter, exemplary embodiments will be described. The following description and examples are merely an example of the exemplary embodiment, and are not intended to limit the scope of the invention.

In a case where the amount of each component in a composition is stated in the present specification, if there are plural types of substances which correspond to each component in the composition, unless specifically noted, the amount means a total amount of the plural types of substances present in the composition.

In the specification, the "electrophotographic photoreceptor" is simply referred to as a "photoreceptor". In the specification, the longitudinal direction of a conductive support or an electrophotographic photoreceptor corresponds to a direction orthogonal to a rotation direction of the conductive support or the electrophotographic photoreceptor.

Conductive Support

The conductive support according to the exemplary embodiment which is formed of a bottomless hollow cylindrical member being made of metal and having a thickness t of equal to or less than 0.5 mm includes a chamfer portion on the outer peripheral surface side of at least one end over the entire circumferential direction. The chamfer portion has a chamfer angle a of equal to or greater than 10° and less than 30° with respect to the outer peripheral surface, and a chamfer width b of equal to or greater than 0.05 mm in an end surface. In addition, in the conductive support according to the exemplary embodiment, an end surface width c is equal to or greater than 0.1 mm of the end surface including the chamfer portion.

The conductive support according to the exemplary embodiment will be described with reference to FIGS. 1 and 2.

Figure 1:
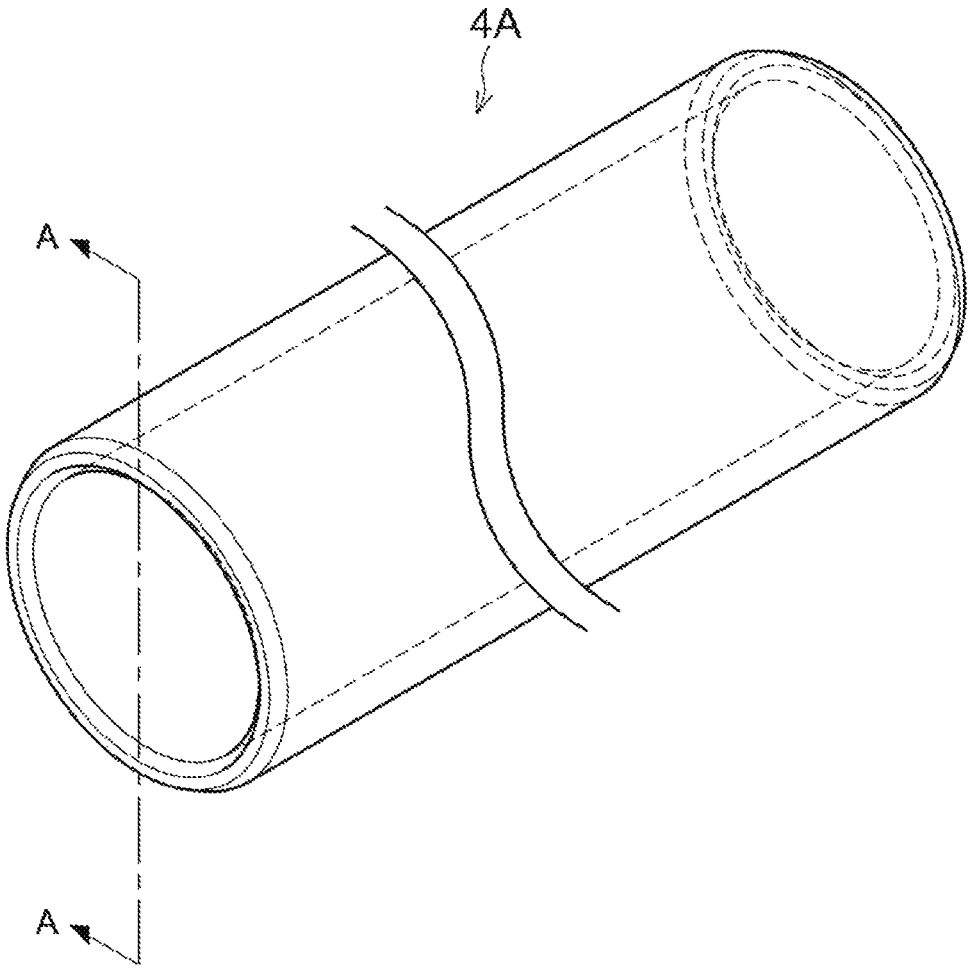
FIG. 1 is a schematic perspective view illustrating an example of a conductive support according to the exemplary embodiment.
Figure 2:
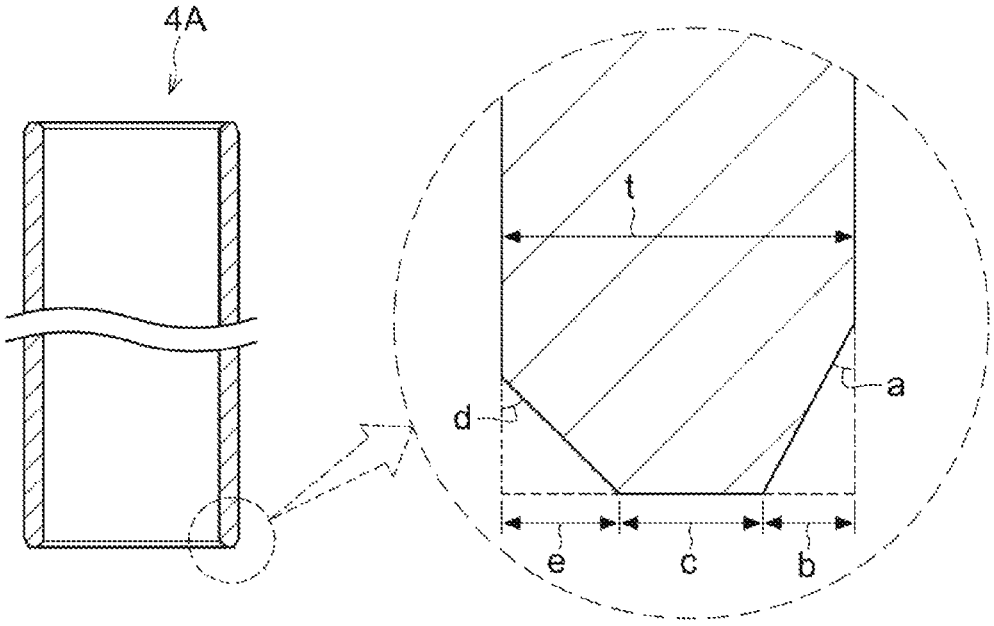
FIG. 2 is a schematic sectional view illustrating an example of the conductive support according to the exemplary embodiment.

FIG. 1 is a schematic perspective view illustrating an example of a conductive support for an electrophotographic photoreceptor, and a conductive support 4A illustrated in FIG. 1 is a bottomless hollow cylindrical member. FIG. 2 is a sectional view taken along line A-A of FIG. 1 and an enlarged view of a portion of the sectional view, which illustrates a cross section when the conductive support 4A is cut in the longitudinal direction and the radial direction.

The conductive support 4A as illustrated in FIG. 1 includes a chamfer portion on the outer peripheral surface side and the inner peripheral surface of both ends over the entire circumferential direction. The conductive support according to the exemplary embodiment is not limited to such a configuration as long as it includes a chamfer portion on the outer peripheral surface side of at least one end over the entire circumferential direction, without including the chamfer portion on the inner peripheral surface side. A shape of a slope of the chamfer portion (a shape indicated in a cross section when the conductive support is cut in the longitudinal direction or the radial direction) may be a straight line or a curved line.

The thickness t is an average thickness of the conductive support in a portion except for the chamfer portion. The thickness t is a value obtained by measuring and averaging totally 40 points of 10 points at equal intervals in the longitudinal direction and four points (increments of 90°) in the circumferential direction of the conductive support.

The chamfer angle a is an angle with respect to the outer peripheral surface, and is formed by an extension line of the outer peripheral surface of the conductive support in the longitudinal direction and the slope of the chamfer portion.

In a case where the shape of the slope of the chamfer portion is a curved line, a straight line connecting a starting point of the chamfering on the outer peripheral surface to a starting point of the chamfering on the end surface is regarded as the slope of the chamfer portion.

The chamfer width b is a distance from the starting point of the chamfering on the end surface to the extension line of the outer peripheral surface in the longitudinal direction.

The end surface width c is the length of the end surface having a chamfer portion in the radial direction. In other words, the end surface width c is a width of a remainder of the end surface after chamfering. In a case where the chamfer portion is included not only on the outer peripheral surface side but also on the inner peripheral surface side, the end surface width c corresponds to the distance between the starting point of the chamfering on the outer peripheral surface side of the end surface and the starting point of the chamfering on the inner peripheral surface side of the end surface.

The chamfering on the inner peripheral surface side is optionally performed. Regarding the chamfer portion on the inner peripheral surface side of the conductive support 4A as illustrated in FIG. 1, a chamfer angle d and a chamfer width e are as follows.

The chamfer angle d is an angle with respect to the inner peripheral surface, and is formed by an extension line of the inner peripheral surface of the conductive support in the longitudinal direction, and the slope of the chamfer portion. In a case where the shape of the slope of the chamfer portion is a curved line, a straight line connecting a starting point of the chamfering on the inner peripheral surface to a starting point of the chamfering on the end surface is regarded as the slope of the chamfer portion.

The chamfer width e is a distance from the starting point of the chamfering on the end surface to the extension line of the inner peripheral surface in the longitudinal direction.

The conductive support according to the exemplary embodiment prevents the sensitivity unevenness from occurring on the photosensitive layer of the photoreceptor in the longitudinal direction. The reason for this is presumed as follows.

In a case of forming a photosensitive layer by dip-coating a relatively thin conductive support with a coating liquid forming a photosensitive layer in the longitudinal direction which is set as the gravity direction, and drying the coated film in a state in which the longitudinal direction is still set as the gravity direction, sensitivity unevenness is likely to occur on the obtained photosensitive layer in the longitudinal direction. At the time of drying the coated film, the coated film on the conductive support becomes thickened at a lower end in the gravity direction and the amount of solvent vaporization is increased in this part, and the relatively thin conductive support has a small heat capacity, and thus the coated film is likely to be cold due to the solvent vaporization and dew condensation is likely to occur, thereby causing unevenness of the properties on the photosensitive layer in the longitudinal direction. For this reason, it is presumed that the sensitivity unevenness occurs on the photosensitive layer in the longitudinal direction as a result.

In contrast, when at least one end of the conductive support on the outer peripheral surface side is chamfered, and the chamfered one end is set as the lower end in the gravity direction and is dip-coated and dried, since the coated film on the conductive support becomes thinner at the lower end in the gravity direction, and the amount of solvent vaporization is relatively decreased in this part, the coated film is prevented from being cold and the dew condensation is also prevented, thereby preventing unevenness of the properties of the photosensitive layer from occurring in the longitudinal direction. For this reason, it is presumed that the sensitivity unevenness is prevented from occurring on the photosensitive layer in the longitudinal direction as a result.

The thickness t in the exemplary embodiment is equal to or less than 0.5 mm, is preferably less than 0.5 mm, and is further preferably equal to or less than 0.4 mm form the viewpoint of weight reduction of the photoreceptor. The thickness t in the exemplary embodiment is preferably equal to or greater than 0.2 mm, and is further preferably equal to or greater than 0.3 mm from the viewpoint of securing the strength of the conductive support and the photoreceptor.

The end surface width c in the exemplary embodiment is preferably equal to or greater than 0.1 mm, is further preferably equal to or greater than 0.15 mm, and is still further preferably equal to or greater than 0.2 mm from the viewpoint of securing the strength of the conductive support and the photoreceptor. The end surface width c in the exemplary embodiment is equal to or less than 0.45 mm from the viewpoint of the relationship between the thickness t and the chamfer width b, and is preferably equal to or less than 0.4 mm, and is further preferably equal to or less than 0.3 mm from the viewpoint that the sensitivity unevenness is prevented from occurring on the photosensitive layer in the longitudinal direction.

The chamfer width b in the exemplary embodiment is preferably equal to or greater than 0.05 mm, is further preferably equal to or greater than 0.1 mm, and is still further preferably equal to or greater than 0.15 mm from the viewpoint that the sensitivity unevenness is prevented from occurring on the photosensitive layer in the longitudinal direction. The chamfer width b in the exemplary embodiment is equal to or less than 0.4 mm from the viewpoint of the relationship between the thickness t and the end surface width c, and is preferably equal to or less than 0.3 mm, and is further preferably equal to or less than 0.25 mm from the viewpoint of securing the strength of the conductive support and the photoreceptor.

The chamfer angle a in the exemplary embodiment is equal to or greater than 10° and less than 30°.

When the chamfer angle a is set to be equal to or greater than 30° and the end surface width c is to be secured to be equal to or greater than 0.1 mm, it is presumed that the distance to be chamfered in the longitudinal direction becomes smaller, and thus it is not possible to prevent the sensitivity unevenness from occurring on the photosensitive layer in the longitudinal direction.

On the other hand, when the chamfer angle a is set to be less than 10°, it is presumed that the inclination of the chamfer is excessively gentle, and thus it is not possible to prevent the sensitivity unevenness from occurring on the photosensitive layer in the longitudinal direction.

From the above-described viewpoints, the chamfer angle a in the exemplary embodiment is equal to or greater than 10° and less than 30°, and is preferably in a range of from 10° to 25°, and is further preferably in a range of from 10° to 20°.

In the conductive support according to the exemplary embodiment, both ends on the inner peripheral surface side may be chamfered or maybe not. For example, both ends on the inner peripheral surface side of the conductive support are chamfered for the purpose of installing a member for mounting the photoreceptor on the image forming apparatus to the conductive support in some cases. The chamfer angle d is, for example, in a range of from 10° to 60°, and is preferably in a range of from 15° to 45°. The chamfer width e is, for example, in a range of from 0.05 mm to 0.2 mm, and is preferably in a range of from 0.05 mm to 0.15 mm.

Examples of the metal forming the conductive support include pure metal such as aluminum, iron, and copper; and an alloy such as a stainless steel and an aluminum alloy. The examples of the metal constituting the conductive support are preferably metal containing aluminum, and are more preferably pure aluminum or an aluminum alloy in terms of the lightness and excellent workability. The aluminum alloy are not particularly limited as long as the alloy has aluminum as a major component, and examples thereof include an aluminum alloy containing Si, Fe, Cu, Mn, Mg, Cr, Zn, Ti, and the like in addition to aluminum. Here, the "major component" means an element having the highest content ratio (by weight) among the elements contained in the alloy. As the metal constituting the conductive support, in terms of the workability, the aluminum content (weight ratio) of the metal to be used is preferably 90.0% or more, more preferably 95.0% or more, and still more preferably 99.0% or more.

A hollow cylindrical tube is obtained through the process such as reducing, drawing, impact pressing, ironing, and cutting, and at least one end of the hollow cylindrical tube on the outer peripheral surface side is chamfered by using a cutting tool in the entire circumferential direction, thereby preparing a conductive support according to the exemplary embodiment. The conductive support according to the exemplary embodiment is prepared by, for example, casting a melted metal into a mold having a chamfer portion.

The conductive support according to the exemplary embodiment may be a member in which a well-known surface treatment such as an anodic oxidation treatment, an oxidation treatment, or a boehmite treatment is subjected to the surface.

In the conductive support according to the exemplary embodiment, the "conductivity" means the volume resistivity which is less than $1\times10^{13}$ Ωcm.

Electrophotographic Photoreceptor

The photoreceptor according to the exemplary embodiment includes the conductive support according to the exemplary embodiment, and a photosensitive layer disposed on the conductive support.

As a method of efficiently preparing the photoreceptor by using the conductive support according to the exemplary embodiment, the following preparing method is exemplified.

A method of preparing the photoreceptor is performed in such a manner that the conductive support is dipped into the coating liquid forming a photosensitive in the longitudinal direction which is set as the gravity direction, and is picked up so as to form a coated film coated with the coating liquid forming a photosensitive layer on the conductive support, and then the coated film is dried in a state in which the longitudinal direction of the conductive support is still set as the gravity direction, thereby forming a photosensitive layer on the conductive support.

The photoreceptor according to the exemplary embodiment includes the conductive support which is metallic hollow cylindrical member, and the photosensitive layer disposed on the conductive support. An undercoat layer may be provided under the photosensitive layer, and the protective layer may be provided on the photosensitive layer.

Figure 3:
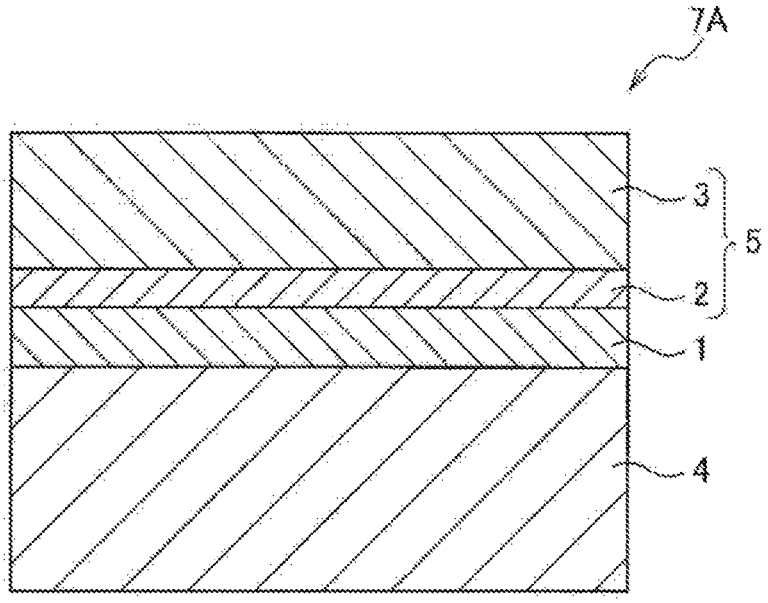
FIG. 3 is a schematic partial sectional view illustrating an example of a layer configuration of an electrophotographic photoreceptor according to the exemplary embodiment.

FIG. 3 is a schematic sectional view illustrating an example of a layer configuration of a photoreceptor. A photoreceptor 7A as illustrated in FIG. 3 has a structure in which an undercoat layer, a charge generation layer 2, and a charge transport layer 3 are sequentially stacked on the conductive support 4. The charge generation layer 2 and the charge transport layer 3 constitute a photosensitive layer 5. The photosensitive layer may be a function separation type photosensitive layer in which the charge generation layer 2 and the charge transport layer 3 are separated from each other as illustrated in FIG. 3, and may be a single-layer type photosensitive layer in which the charge generation layer 2 and the charge transport layer 3 are integrated with each other. A protective layer may be further provided on the photosensitive layer 5. The undercoat layer 1 may not be provided.

Hereinafter, the respective layers of the photoreceptor will be described in detail. Reference numerals will not be described.

The undercoat layer is a layer including, for example, an inorganic particles and a binder resin.

Examples of the inorganic particle include inorganic particles having powder resistance (volume resistivity) in a range of from $1\times10^{2}$ Ωcm to $1\times10^{11}$ Ωcm. Among them, as the inorganic particle having the above resistance value, metal oxide particles such as tin oxide particles, titanium oxide particles, zinc oxide particles, and zirconium oxide particles may be used, and particularly, the zinc oxide particles are preferably used.

A specific surface area of the inorganic particle by BET method may be, for example, equal to or greater than 10 $m^2/g$.

The volume average particle diameter of the inorganic particle may be, for example, in a range of from 50 nm to 2,000 nm (preferably in a range of from 60 nm to 1,000 nm).

The content of the inorganic particle is, for example, is preferably in a range of from 10% by weight to 80% by weight, and is further preferably in a range of from 40% by weight to 80% by weight, with respect to the binder resin.

The inorganic particle may be subjected to the surface treatment. Two or more inorganic particles which are subjected to the surface treatment in a different way, or which have different particle diameters may be used in combination.

Examples of a surface treatment agent include a silane coupling agent, a titanate coupling agent, an aluminum coupling agent, and a surfactant. Particularly, the silane coupling agent is preferably used, and a silane coupling agent having an amino group is further preferably used.

Examples of the silane coupling agent having an amino group include 3-aminopropyl triethoxy silane, N-2-(aminoethyl)-3-aminopropyl trimethoxy silane. N-2-(aminoethyl)-3-aminopropyl methyl dimethoxy silane, and N,N-bis(2-hydroxy ethyl)-3-aminopropyl triethoxy silane; however, the silane coupling agent is not limited to these examples.

Two or more types of the silane coupling agents may be used in combination. For example, the silane coupling agent having an amino group and other silane coupling agents may be used in combination. Examples of other silane coupling agents include vinyl trimethoxysilane, 3-methacryloxypropyl-tris(2-methoxyethoxy) silane, 2-(3,4-epoxycyclohexyl) ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, 3-chloropropyl trimethoxy silane; however, other silane coupling agents are not limited to these examples.

The method of surface treatment by using the surface treatment agent is not limited as long as it is a well-known method, and a drying method or a wet method may be used.

The amount of the surface treatment agent is, for example, preferably in a range of from 0.5% by weight to 10% by weight with respect to the inorganic particle.

Here, the undercoat layer may include an inorganic particle and an electron-accepting compound (acceptor compound) from the viewpoint that long-term stability of electrical characteristics and the carrier blocking properties are improved.

Examples of the electron-accepting compound include an electron transporting substance, for example, a quinone compound such as chloranil and bromanil; a tetracyanoquinodimethane compound; a fluorenone compound such as 2,4,7-trinitrofluorenone, 2,4,5,7-tetranitro-9-fluorenone; an oxadiazole compound such as 2-(4-biphenyl)-5-(4-t-butyl phenyl)-1,3,4-oxadiazole, 2,5-bis(4-naphthyl)-1,3,4-oxadiazole, 2,5-bis(4-diethyl amino-phenyl) 1,3,4-oxadiazole; a xanthone compound; a thiophene compound; and a diphenoquinone compound such as 3,3',5,5' tetra-t-butyl diphenoquinone. Particularly, as the electron-accepting compound, a compound having an anthraquinone structure is preferably used. As the compound having an anthraquinone structure, for example, a hydroxyanthraquinone compound, an amino anthraquinone compound, and an amino hydroxy anthraquinone compound are preferably used, and specifically, anthraguinone, alizarin, guinizarin, anthrarufin, and purpurin are preferably used.

The electron-accepting compound may be dispersed in the undercoat layer together with the inorganic particle, or may be attached on the surface of the inorganic particle.

Examples of the method of attaching the electron-accepting compound on the surface of the inorganic particle include a drying method and a wet method.

The drying method is a method of attaching the electron-accepting compound to the surface of the inorganic particle, for example, the electron-accepting compound or the electron-accepting compound which is dissolved in the organic solvent is added dropwise, and is sprayed with dry air or nitrogen gas while stirring the inorganic particle by using a mixer having a large shear force. The electron-accepting compound may be added dropwise or sprayed at a temperature below the boiling point of the solvent. After the electron-accepting compound is added dropwise or sprayed, sintering may be performed at a temperature of equal to or greater than 100° C. The sintering is not particularly limited as long as a temperature and time for obtaining the electrophotographic properties are provided.

The wet method is a method of attaching the electron-accepting compound to the surface of the inorganic particle by removing the solvent after the electron-accepting compound is added and stirred or dispersed while dispersing the inorganic particles in the solvent through a stirrer, ultrasound, a sand mill, an attritor, a ball mill, and the like. As a method of removing a solvent, for example, the solvent is distilled off by filtration or distillation. After removing the solvent, sintering may be performed at a temperature of equal to or greater than 100° C. The sintering is not particularly limited as long as a temperature and time for obtaining the electrophotographic properties are provided. In the wet method, the water content of the inorganic particle may be removed before adding the electron-accepting compound, and examples thereof includes a method of removing the water content of the inorganic particle while stirring and heating in the solvent, and a method of removing the water content of the inorganic particle by forming an azeotrope with the solvent.

Attaching the electron-accepting compound may be performed before or after performing the surface treatment on the inorganic particle by using a surface treatment agent, and the attaching of the electron-accepting compound and the surface treatment by using a surface treatment agent may be concurrently performed.

The content of the electron-accepting compound may be in a range of from 0.01% by weight to 20% by weight, and is preferably in a range of from 0.01% by weight to 10% by weight with respect to the inorganic particle.

Examples of the binder resin used for the undercoat layer include a well-known polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, vinyl chloride-vinyl acetate-maleic anhydride resin, a silicone resin, a silicone-alkyd resin, a urea resin, a phenol resin, a phenol-formaldehyde resin, a melamine resin, an urethane resin, an alkyd resin, and an epoxy resin; a zirconium chelate compound; a titanium chelate compound; an aluminum chelate compound; a titanium alkoxide compound; an organic titanium compound; and a well-known material such as an a silane coupling agent.

Examples of the binder resin used for the undercoat layer include a charge transport resin having a charge transport group, and a conductive resin (for example, polyaniline).

Among them, as the binder resin used for the undercoat layer, an insoluble resin in the coating solvent for the upper layer is preferably used. Particularly, examples thereof include a thermosetting resin such as a urea resin, a phenol resin, a phenol-formaldehyde resin, a melamine resin, a urethane resin, an unsaturated polyester resin, an alkyd resin, and an epoxy resin; and a resin obtained by reaction of at least one resin selected from the group consisting of a polyamide resin, a polyester resin, a polyether resin, a methacrylic resin, an acrylic resin, a polyvinyl alcohol resin, and a polyvinyl acetal resin, and a curing agent.

In a case where two or more binder resins are used in combination, the mixing ratio thereof is set if necessary.

The undercoat layer may contain various types of additives so as to improve electrical properties, environmental stability, and image quality.

Examples of the additive include well-known materials, for example, an electron transporting pigment such as a polycyclic condensed pigment and an azo pigment, a zirconium chelate compound, a titanium chelate compound, an aluminum chelate compound, a titanium alkoxide compound, an organic titanium compound, and a silane coupling agent. The silane coupling agent is used for the surface treatment of the inorganic particle as described above, and may be also added to the undercoat layer as an additive.

Examples of the silane coupling agent as an additive include vinyl trimethoxy silane, 3-methacryloxy propyl-tris (2-methoxyethoxy)silane, 2-(3,4-epoxycyclohexyl)ethyl trimethoxy silane, 3-glycidoxypropyl trimethoxysilane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, and 3-chloro-propyl trimethoxy silane.

Examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, poly titanium acetylacetonate, titanium octylene glycolate, titanium lactate ammonium salt, titanium, lactate, titanium lactate ethyl ester, titanium triethanolaminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, aluminum tris (ethyl acetoacetate).

The above-described additives may be used alone or may be used as a mixture of plural compounds or polycondensate.

The Vickers' hardness of the undercoat layer may be equal to or greater than 35.

In order to prevent the occurrence of moire images, the surface roughness (ten-point average roughness) of the undercoat layer may be adjusted to ½ from 1/(4n) (n is the refractive index of the upper layer) of the used exposure laser wavelength λ.

The resin particle or the like may be added into the undercoat layer so as to adjust the surface roughness. Examples of the resin particle include a silicone resin particle, and a cross linked polymethyl methacrylate resin particle. The surface of the undercoat layer may be polished so as to adjust the surface roughness. Examples of a polishing method include a buffing method, a sandblasting method, a wet honing method, and a grinding method.

The forming of the undercoat layer is not particularly limited, and a well-known forming method is used. For example, the method is performed in such a manner that a coated film coated with the coating liquid for forming an undercoat layer to which the above-described components are added as a solvent is formed, dried, and then heated if necessary.

Examples of the solvent for preparing the coating liquid for forming an undercoat layer include a well-known organic solvent such as an alcohol solvent, an aromatic hydrocarbon solvent, a halogenated hydrocarbon solvent, a ketone solvent, a ketone alcohol solvent, an ether solvent, and an ester solvent.

Specific examples of the solvent include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A method of dispersing inorganic particles at the time of preparing the coating liquid for forming an undercoat layer includes a well-known method by using a roll mill, a ball mill, a vibrating ball mill, an attritor, a sand mill, a colloid mill, and a paint shaker.

Examples of the method of coating the conductive support with the coating liquid for forming an undercoat layer include a general method such as a blade coating method, a wire-bar coating method, a spray coating method, a dip-coating method, a bead coating method, an air knife coating method, and a curtain coating method.

Examples of a step of efficiently forming the undercoat layer on the conductive support according to the exemplary embodiment include the following step.

The conductive support is dipped into the coating liquid for forming an undercoat layer in the longitudinal direction which is set as the gravity direction, and is picked up so as to form a coated film coated with the coating liquid for forming an undercoat layer on the conductive support, and then the coated film is dried in a state in which the longitudinal direction of the conductive support is still set as the gravity direction, thereby forming the undercoat layer on the conductive support.

The thickness of the undercoat layer is set to be, for example, preferably equal to or greater than 15 μm, and further preferably in a range of from 20 μm to 50 μm.

Intermediate Layer

Although not shown in the drawings, an intermediate layer may be further provided between the undercoat layer and the photosensitive layer.

The intermediate layer is a layer including a resin. Examples of the resin used for the intermediate layer include a polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride vinyl acetate-maleic anhydride resin, a silicone resin, a silicone-alkyd resin, a phenol-formaldehyde resin, and a melamine resin.

The intermediate layer may be a layer including an organometallic compound. Examples of the organometallic compound used for the intermediate layer include an organometallic compound containing a metal atom such as zirconium, titanium, aluminum, manganese, and silicon.

The compounds used for the intermediate layer may be used alone, or may be used as a mixture of plural compounds or a polycondensate.

Among them, the intermediate layer is preferably a layer including an organometallic compound containing a zirconium atom or a silicon atom.

The forming of the intermediate layer is not particularly limited, and a well-known forming method is used. For example, the method is performed in such a manner that a coated film coated with the coating liquid for forming an intermediate layer to which the above-described components are added as a solvent is formed, dried, and then heated if necessary.

Examples of a coating method for forming an intermediate layer include a general method such as a dip-coating method, an extrusion coating method, a wire-bar coating method, a spray coating method, a blade coating method, a knife coating method, and a curtain coating method.

Examples of a step of efficiently forming the intermediate layer on the undercoat layer include the following step.

The conductive support including the undercoat layer is dipped into the coating liquid for forming an intermediate layer in the longitudinal direction which is set as the gravity direction, and is picked up so as to form a coated film of the coating liquid for forming an intermediate layer on the undercoat layer, and then the coated film is dried in a state in which the longitudinal direction of the conductive support is still set as the gravity direction, thereby forming the intermediate layer on the undercoat layer.

The thickness of the intermediate layer is set to be preferably in a range of from 0.1 μm to 3 μm, for example. The intermediate layer may be used as the undercoat layer.

Charge Generation Layer

The charge generation layer includes, for example, a charge generation material and a binder resin. In addition, the charge generation layer may be a deposited layer of the charge generation material. The deposited layer of the charge generation material is preferably used in a case where a non-coherent light source such as a light-emitting diode (LED), organic electro-luminescence (EL) image array is used.

Examples of the charge generation material include an azo pigment such as bisazo and trisazo; a condensed aromatic pigment such as dibromoanthanthrone; a perylene pigment; a pyrrolopyrrole pigment; phthalocyanine pigment; zinc oxide; and trigonal selenium.

Among them, in order to correspond to the laser exposure in the near infrared region, a metal phthalocyanine pigment, or a non-metal phthalocyanine pigment are preferably used as the charge generation material. Specific examples thereof include hydroxy gallium phthalocyanine; chloro gallium phthalocyanine; dichlorotin phthalocyanine; and titanyl phthalocyanine.

On the other hand, in order to correspond to the laser exposure in the near ultraviolet region, a condensed aromatic pigment such as dibromoanthanthrone; a thioindigo pigment; a porphyrazine compound; zinc oxide; trigonal selenium; and a bisazo pigment are preferably used as the charge generation material.

In a case of using the non-coherent, light source such as LED, and the organic EL image array which have the central wavelength of the emitted light in the range of 450 nm to 780 nm, the above-described charge generation material may be used; however, in terms of the resolution, when the photosensitive layer having a thickness of equal to or less than 20 μm is used, the electric field strength is enhanced in the photosensitive layer, and due to reduction of charging by the charge injection from the conductive support, an image defect which is so-called "black dot" is likely to occur. This phenomine is remarkable when the charge generation material which is a p-type semiconductor such as trigonal selenium and a phthalocyanine pigment, and easily causes a dark current is used.

In contrast, in a case of using a n-type semiconductor such as a condensed aromatic pigment, a perylene pigment, and an azo pigment as the charge generation material, the dark current is less likely to occur and the image defect which is the so-called dark dot may be prevented even with thin film.

The determination of the n-type is performed by polarity of flowing photocurrent with a time-of-flight method which is generally used, and a material which causes electrons to easily flow as carriers as compared with a hole is set as a n-type.

The binder resin used for the charge generation layer may be selected from the insulating resins in a wide range, or may be selected from organic photoconductive polymers such as poly-N-vinyloarbazole, polyvinyl anthracene, polyvinyl pyrene, and polysilanes.

Examples of the binder resin include a polyvinyl butyral resin, a polyarylate resin (a polycondensate of bisphenol and an aromatic dicarboxylic acid), a polycarbonate resin, a polyester resin, a phenoxy resin, a vinyl chloride-vinyl acetate copolymer, a polyamide resin, an acrylic resin, a polacrylamide resin, a polyvinyl pyridine resin, a cellulose resin, an urethane resin, an epoxy resin, casein, a polyvinyl alcohol resin, and a polyvinyl pyrrolidone resin. Here "insulation properties" mean a case where the volume resistivity is equal to or greater than $1\times10^{13}$ Ωcm. These binder resins may be used alone or two or more types thereof may be used in combination.

The mixing ratio of the charge generation material to the binder resin is preferably in a range of from 10:1 to 1:10 by the weight ratio.

The charge generation layer may include other well-known additives.

The charge generation layer is not particularly limited, and a well-known forming method is used. For example, the method is performed in such a manner that a coated film coated with the coating liquid for forming a charge generation layer to which the above-described components are added as a solvent is formed, dried, and then heated if necessary. The forming of the charge generation layer may be performed by vaporizing the charge generation material. The forming of the charge generation layer performed by vaporizing the charge generation material is particularly preferable in a case where a condensed aromatic pigment and a perylene pigment are used as the charge generation material.

Examples of the solvent for preparing coating liquid for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or two or more type thereof may be used in combination.

Examples of a method of dispersing the particles (for example, charge generation material) in the coating liquid forming a charge generation layer include a method by using a media dispersing machine such as a ball mill, a vibrating ball mill, an attritor, a sand mill, and a horizontal sand mill, and a media-less disperser such as a stirrer, an ultrasonic disperser, a roll mill, and a high pressure homogenizer. Examples of the high-pressure homogenizer include a collision-type homogenizer in which a dispersion is dispersed liquid-liquid collision, and liquid-wall collision under high pressure, and a passing-through-type homogenizer in which a dispersion is dispersed by passing the dispersion through thin flow paths under high pressure. At the time of this dispersion, the average particle diameter of the charge generation material in the coating liquid forming a charge generation layer is equal to or less than 0.5 μm, is preferably equal to or less than 0.3 μm, and further preferably equal to or less than 0.15 μm.

Examples of a method of coating the undercoat layer (or on the intermediate layer) with the coating liquid forming a charge generation layer include a general method such as a blade coating method, a wire-bar coating method, a spray coating method, a dip-coating method, a bead coating method, an air knife coating method, and a curtain coating method.

Examples of a step of efficiently forming the charge generation layer on the undercoat layer (or the intermediate layer) include the following step.

The conductive support including the undercoat layer (or the undercoat layer and the intermediate layer) is dipped into the coating liquid forming a charge generation layer in the longitudinal direction which is set as the gravity direction, and is picked up so as to form a coated film of the coating liquid forming a charge generation layer on the undercoat layer (or the intermediate layer), and then the coated film is dried in a state in which the longitudinal direction of the conductive support is still set as the gravity direction, thereby forming the charge generation layer on the undercoat layer (or the intermediate layer).

The thickness of the charge generation layer is preferably set to be in a range of from 0.1 μm to 5.0 μm, and is further preferably set to be in a range of from 0.2 μm to 2.0 μm, for example.

Charge Transport Layer

The charge transport layer is, for example, a layer including a charge transport material and a binder resin. The charge transport layer may be a layer including a polymer charge transport material.

Examples of the charge transport material include an electron transporting compound such as a quinone compound such as p-benzoquinone, chloranil, bromanil, and anthraguinone; a tetracyanoquinodimethane compound; a fluorenone compound such as 2,4,7-trinitrofluorenone; xanthone compound; a benzophenone compound; and a cyanovinyl compound; an ethylene compound. Examples of the charge transport material include a hole-transporting compound such as a triaryl amine compound, a benzidine compound, an arylalkane compound, an aryl substituted ethylene compound, a stilbene compound, an anthracene compound, and a hydrazine compound. These charge transport materials may be used alone or two or more types thereof may be used, but are not limited thereto.

As the charge transport material, in terms of charge mobility, a triarylamine derivative represented by the following formula (a-1) and a benzidine derivative represented by the following formula (a-2) are preferably used.

(a-1)

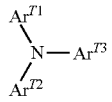

In formula (a-1), $Ar^{T1}$, $Ar^{T2}$ and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group. Examples of the substituent of the respective groups include a halogen atom, an alkyl group having from 1 to 5 carbon atoms, and an alkoxy group having from 1 to 5 carbon atoms. In addition, examples of the substituent of the respective groups include a substituted amino group which is substituted with an alkyl group having from 1 to 3 carbon atoms.

(a-2)

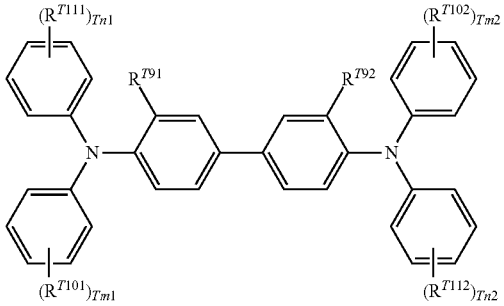

In formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$ and $R^{T112}$ each independently represent a halogen atom, an alkyl group having from 1 to 5 carbon atoms, an alkoxy group having from 1 to 5 carbon atoms, an amino group which is substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$ and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer of from 0 to 2. Examples of the substituent of the respective groups include a halogen atom, an alkyl group having from 1 to 5 carbon atoms, and an alkoxy group having from 1 to 5 carbon atoms. In addition, examples of the substituent of the respective groups include a substituted amino group which is substituted with an alkyl group having from 1 to 3 carbon atoms.

Among a triarylamine derivative represented by formula (a-1) and a benzidine derivative represented by the formula (a-2), a triarylamine derivative having "$—C_6H_4—CH=CH—CH=C(R^{T7})(R^{T8})$", and a benzidine derivative having "$—CH=CH—CH=C(R^{T15})(R^{T16})$" are particularly preferable in terms of the charge mobility.

As the polymer charge transport material, a known material having charge transporting properties such as poly-N-vinylcarbazole and polysilane is used. Particularly, a polyester polymer charge transport material is preferable. The polymer charge transport material may be used alone, or may be used in combination with the binder resin.

Examples of the binder resin used for the charge transport layer include a polycarbonate resin, a polyester resin, a polyarylate resin, a methacrylic resin, anacrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among them, as the binder resin, the polycarbonate resin and the polyarylate resin are preferably used. These binder resins may be used alone or two or more types thereof may be used in combination.

The mixing ratio of the charge transport material to the binder resin is from 10:1 to 1:5 by the weight ratio.

The charge transport layer may include other well-known additives.

The charge transport layer is not particularly limited, and a well-known forming method is used. For example, the method is performed in such a manner that a coated film coated with the coating liquid for forming a charge transport layer to which the above-described components are added as a solvent is formed, dried, and then heated if necessary.

Examples of the solvent for preparing the coating liquid forming a charge transport layer includes general organic solvents such as aromatic hydrocarbons such as benzene, toluene, xylene, and chlorobenzene; ketones such as acetone and 2-butanone; halogenated aliphatic hydrocarbons such as methylene chloride, chloroform, and methylene chloride; and cyclic or linear ethers such as tetrahydrofuran and ethyl ether. These solvents may be used alone or two or more types thereof may be used in combination.

Examples of the method of coating the charge generation layer with the coating liquid for forming a charge transport layer include a general method such as a blade coating method, a wire-bar coating method, a spray coating method, a dip-coating method, a bead coating method, an air knife coating method, and a curtain coating method.

Examples of a step of efficiently forming the charge transport layer on the charge generation layer include the following step.

The conductive support including the charge generation layer is dipped into the coating liquid forming a charge transport layer in the longitudinal direction which is set as the gravity direction, and is picked up so as to form a coated film of the coating liquid forming a charge transport layer on the charge generation layer, and then the coated film is dried in a state in which the longitudinal direction of the conductive support is still set as the gravity direction, thereby forming the charge transport layer on the charge generation layer.

The thickness of the charge transport layer is, for example, preferably set to be in a range of from 5 μm to 50 μm, and is further preferably set to be in a range of from 10 μm to 30 μm.

Protective Layer

The protective layer is provided on the photosensitive layer if necessary. For example, the protective layer is provided so as to prevent the photosensitive layer during charge from being chemically changed, or to further enhance the technical strength of the photosensitive layer.

For this reason, the protective layer may employ a layer formed of a cured film (a cross-linked membrane). Examples of these layers include layers described in the following description 1) or 2).

1) A layer which is formed of a cured film of a composition including a reactive group-containing charge transport material having a reactive group and a charge transport skeleton in the same molecule (that is, a layer including a polymer or a crosslinked polymer of the reactive group-containing charge transport material)

2) A layer which is formed of a cured film of a composition including a non-reactive charge transport material and a reactive group-containing non-charge transport material having a reactive group without a charge transport skeleton (that is, a layer including a polymer or crosslinked polymer a non-reactive charge transport material and the reactive group-containing non-charge transport material)

Examples of the reactive group of the reactive group-containing charge transport material include well-known reactive groups such as a chain polymerization group, an epoxy group, —OH, —OR [here, R represents an alkyl group], —$NH_2$, —SH, —COOH, —$SiR^{Q1}{}_{3-Qn}(OR^{Q2})_{Qn}$ [here, $R^{Q1}$ represents a hydrogen atom, an alkyl group, or a substituted or non-substituted aryl group, $R^{Q2}$ represents a hydrogen atom, an alkyl group, and a trialkylsilyl group. Qn represents integer of from 1 to 3].

The chain polymerization group is not particularly limited as long as it is a functional group capable of radical polymerization, and examples thereof include a functional group having a group containing at least carbon double bond. Specific examples thereof include a group containing at least one selected from a vinyl group, a vinyl ether group, a vinyl thioether group, a styryl group (vinyl phenyl group), an acryloyl group, a methacryloyl group, and derives thereof. Among them, in terms of excellent reactivity, a group containing at least one selected from a vinyl group, a styryl group (vinyl phenyl group), an acryloyl group, a methacryloyl group, and the derives thereof is preferably used as the chain polymerization group.

The charge transport skeleton of the reactive group-containing charge transport material is not particularly limited as long as it is a well-known structure in the photoreceptor. For example, a skeleton derived from a nitrogen-containing hole transport compound such as a triarylamine compound, a benzidine compound, and a hydrazine compound is used, and examples thereof include a structure conjugated with a nitrogen atom. Among them, the triarylamine skeleton is preferably used.

The reactive group-containing charge transport material having the reactive group and the charge transport skeleton, the non-reactive charge transport material, and the reactive group-containing charge transport material may be selected from well-known materials.

The protective layer may include other well-known additives.

The forming of the protective layer is not particularly limited, and a well-known forming method is used. For example, the method is performed in such a manner that a coated film coated with the coating liquid for forming a protective layer to which the above-described components are added as a solvent is formed, dried, and then heated if necessary.

Examples of the solvent for preparing the coating liquid for forming a protective layer includes an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; and an alcohol solvent such as isopropyl alcohol and butanol. These solvents may be used alone or two or more types thereof may be used in combination. The coating liquid for forming a protective layer may be a coating liquid of an inorganic solvent.

Examples of the method of coating the photosensitive layer (for example, a charge transport layer) with the coating liquid for forming a protective layer include a general method such as a dip-coating method, an extrusion coating method, a wire-bar coating method, a spray coating method, a blade coating method, a knife coating method, and a curtain coating method.

Examples of a step of forming the protective layer on the photosensitive layer include the following step.

The conductive support including the photosensitive layer is dipped into the coating liquid forming a protective layer in the longitudinal direction which is set as the gravity direction, and is picked up so as to form a coated film of the coating liquid forming a protective layer on the photosensitive layer, and then the coated film is dried in a state in which the longitudinal direction of the conductive support is still set as the gravity direction, thereby forming the protective layer on the photosensitive layer.

The thickness of the protective layer is preferably in a range of from 1 μm to 20 μm, and further preferably in a range of from 2 μm to 10 μm.

Single Layer-Type Photosensitive Layer

The single layer-type photosensitive layer (a charge generation/transport layer) is a layer including, for example, a charge generation material and a charge transport material, and a binder resin and other well-known additives if necessary. Note that, these materials are the same as those in the description of the charge generation layer and the charge transport layer.

In the single layer-type photosensitive layer, the content of the charge generation material may be in a range of from 10% by weight to 85% by weight, and is further preferably in a range of from 20% by weight to 50% by weight with respect, to the entire solid content. In addition, in the single layer-type photosensitive layer, the content of the charge transport material may be in a range of from 5% by weight to 50% by weight with respect to the entire solid content. The method of forming the single layer-type photosensitive layer is the same as the method of forming the charge generation layer or the charge transport layer.

The thickness of the single layer-type photosensitive layer is, for example, in a range of from 5 μm to 50 μm, and is further preferably in a range of from 10 μm to 40 μm.

Image Forming Apparatus and Process Cartridge

The image forming apparatus according to the exemplary embodiment includes the photoreceptor, a charging unit that charges a surface of the photoreceptor, an electrostatic latent image forming unit that forms an electrostatic latent image on the charged surface of the photoreceptor, a developing unit that forms a toner image by developing the electrostatic latent image formed on the surface of the photoreceptor by using a developer containing a toner, and a transfer unit that transfers the toner image to a surface of a recording medium. In addition, as the photoreceptor, the photoreceptor according to the exemplary embodiment is employed.

As the image forming apparatus according to the exemplary embodiment, well-known image forming apparatuses such as an apparatus including fixing unit that fixes a toner image transferred on a surface of a recording medium; a direct-transfer type apparatus that directly transfers the toner image formed on the surface of the photoreceptor to the recording medium; an intermediate transfer type apparatus that primarily transfers the toner image formed on the surface of the photoreceptor to a surface of an intermediate transfer member, and secondarily transfers the toner image transferred to the surface of the intermediate transfer member to the surface of the recording medium; an apparatus including a cleaning unit that cleans the surface of the photoreceptor before being charged and after transferring the toner image; an apparatus that includes an erasing unit that erases charges by irradiating the surface of the photoreceptor with erasing light before being charged and after transferring the toner image; and an apparatus including a photoreceptor heating member that increases the temperature of the photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the photoreceptor to the surface of the intermediate transfer member, and a secondary transfer unit that secondarily transfers the toner image formed on the surface of the intermediate transfer member to the surface of the recording medium.

The image forming apparatus according to the exemplary embodiment may be any type of a dry developing type image forming apparatus and a wet developing type (developing type using a liquid developer) image forming apparatus.

In the image forming apparatus according to the exemplary embodiment, for example, a unit including the photoreceptor may be a cartridge structure (process cartridge) detachable from the image forming apparatus. As a process cartridge, for example, a process cartridge including the photoreceptor according to the exemplary embodiment is preferably used. In addition, in addition to the photoreceptor, at least one selected from the group consisting of a charging unit, an electrostatic latent image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

Figure 4:
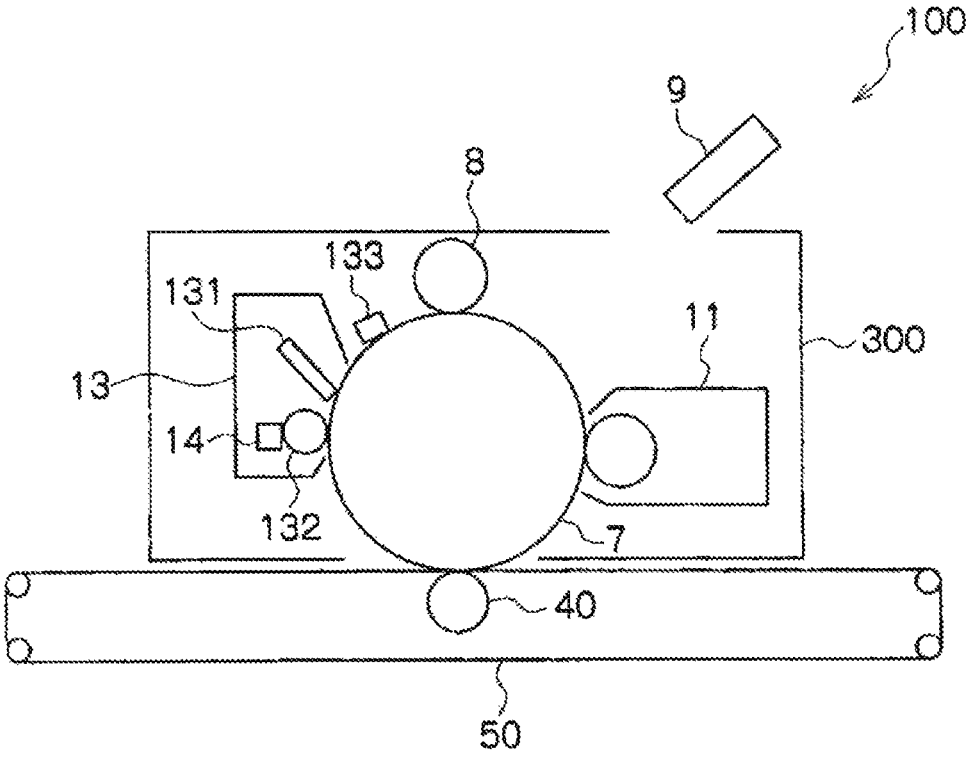
FIG. 4 is a schematic configuration diagram illustrating an example of an image forming apparatus according to the exemplary embodiment.

FIG. 4 is a schematic configuration diagram illustrating an example of the image forming apparatus according to the exemplary embodiment.

As illustrated in FIG. 4, an image forming apparatus 100 according to the exemplary embodiment includes a process cartridge 300 which is provided with a photoreceptor 7, an exposure device 9 (an example of the electrostatic latent image forming unit), a transfer device 40 (an example of the primary transfer device), and an intermediate transfer member 50. In the image forming apparatus 100, the exposure device 9 is disposed at a position so as to expose the photoreceptor 7 from an opening of the process cartridge 300, the transfer device 40 is disposed at a position facing the photoreceptor 7 via the intermediate transfer member 50, and the intermediate transfer member 50 is disposed such that a portion thereof contacts the photoreceptor 7. Although not shown, the image forming apparatus 100 also includes a secondary transfer device that transfers the toner image which is transferred to the intermediate transfer member 50 to a recording medium (for example, recording sheet). The intermediate transfer member 50, the transfer device 40 (the primary transfer device), and the secondary transfer device (not shown) correspond to examples of the transfer unit.

The process cartridge 300 in FIG. 4 integrally supports the photoreceptor 7, a charging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, the cleaning blade 131 is disposed so as to contact the surface of the photoreceptor 7. Note that, the cleaning member is not limited to the cleaning blade 131, and may be a conductive or an insulating fibrous member, which may be used alone or used in combination with the cleaning blade 131.

FIG. 4 illustrates an example of the image forming apparatus including a fibrous member 132 (roller shape) for supplying a lubricant 14 to the surface of the photoreceptor 7, and a fibrous member 133 (flat brush) for assisting the cleaning step, and the above members are disposed as necessary.

Hereinafter, the respective configurations of the image forming apparatus according to the exemplary embodiment will be described.

Charging Device

Examples of the charging device 8 include a contact type charging member using a conductive or a semi conductive charging roller, a charging brush, a charging film, a charging rubber blade, and a charging tube. In addition, well-known charging devices such as a non-contact type roller charging device, a scorotron charging device using corona discharge and a corotron charging device are also used.

Exposure Device

Examples of the exposure device 9 include an optical device that exposes the light such as a semiconductor laser beam, LED light, and liquid crystal shutter light according to a defined image data on the surface of the photoreceptor 7. The wavelength of the light source is set to be within a spectral sensitivity region of the photoreceptor. The wavelength of the semiconductor laser beam mainly near-infrared having an oscillation wavelength in the vicinity of 780 nm however, the wavelength is not limited, the oscillation wavelength laser having a level of 600 nm or laser having the oscillation wavelength in a range of 400 nm to 450 nm as a blue laser may be also used. In addition, a surface emission-type laser light source capable of outputting a multi-beam is also effective to form a color image.

Developing Device

Examples of the developing device 11 include a general developing device that contacts or non-contacts a developer so as to develop an image. The developing device 11 is not particularly limited as long as it has the above-described function, and is selected on the purpose. For example, a well-known developing device having a function of attaching a single-component developer or a two-component developer to the photoreceptor 7 by using a brush, a roller, or the like may be exemplified. Among them, a developing roller holding the developer on the surface is preferably used.

The developer used for the developing device 11 may be a single-component developer containing only a toner or may be a two-component developer containing a toner and a carrier. In addition, the developer may be magnetic or non-magnetic. As the developer, well-known developers are used.

Cleaning Device

As the cleaning device 13, a cleaning blade-type device including a cleaning blade 131 used. In addition to the cleaning blade-type device, a fur brush cleaning device and a simultaneous developing and cleaning device may be also employed.

Transfer Device

Examples of the transfer device 40 include well-known transfer charging device such as a contact type transfer charging device using a belt, a roller, a film, a rubber blade, and the like, a scorotron transfer charging device using corona discharge, and a corotron transfer charging device.

Intermediate Transfer Member

Examples of the intermediate transfer member 50 include a belt-type member (an intermediate transfer belt) containing polyimide, polyamideimide, polycarbonate, polyarylate, polyester, rubber, and the like to which semi conductivity is imparted. The shape of the intermediate transfer member may be drum in addition to the belt shape.

Figure 5:
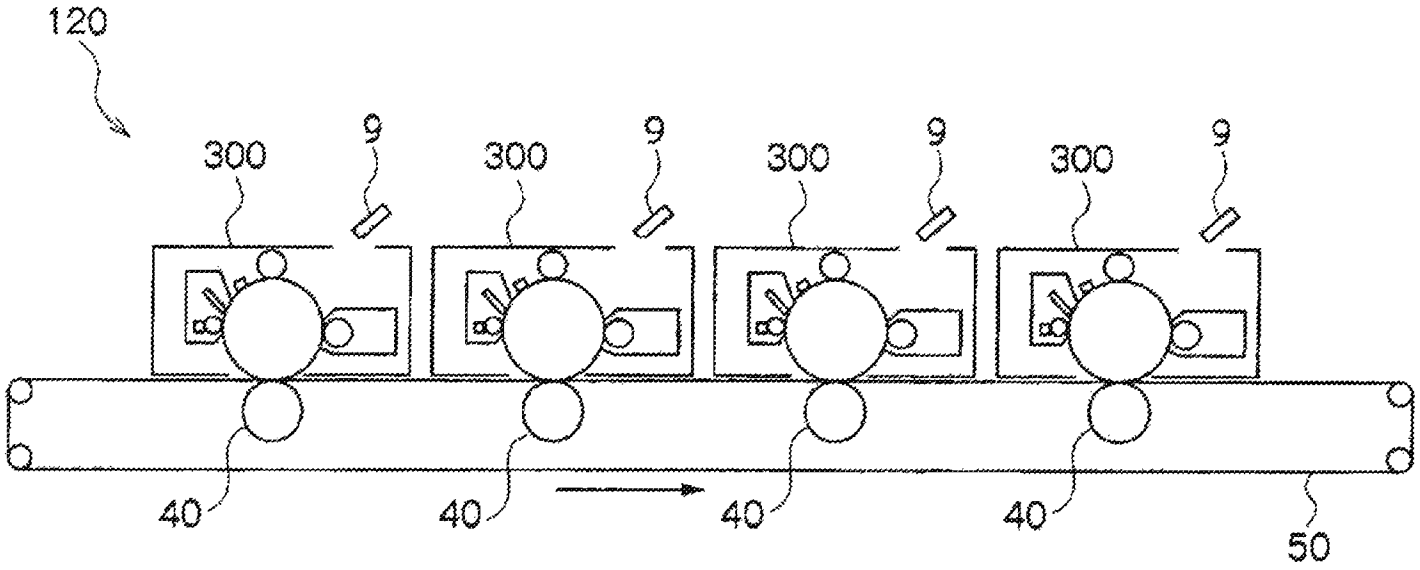
FIG. 5 is a schematic configuration diagram illustrating another example of an image forming apparatus according to the exemplary embodiment.

FIG. 5 is a schematic configuration diagram illustrating another example of an image forming apparatus according to the exemplary embodiment.

The image forming apparatus 120 illustrated in FIG. 5 is a tandem type multi-color image forming apparatus including four process cartridges 300. In the image forming apparatus 120, the four process cartridges 300 are arranged in parallel on the intermediate transfer member 50, and one photoreceptor is used for one color. The image forming apparatus 120 has a configuration which is the same as that of the image forming apparatus 100 except that it is a tandem type image forming apparatus.

EXAMPLES

Hereinafter, the exemplary embodiment is described in detail with reference to examples; however, the exemplary embodiment is not limited to the following examples.

Preparation of Conductive Supports 1 to 73

A bottomless aluminum substrate (aluminum purity of 99.7% or more, JIS designation: A1070 alloy) having an outer diameter of 30 mm, a thickness (t) of 0.5 mm, and a length of 251 mm is prepared. Both ends of the aluminum substrate on the inner peripheral surface side are chamfered by using a cutting tool in the entire circumferential direction such that the chamfer angle d is 45°, the chamfer width e is 0.1 mm, and the slope shape of the chamfer portion is a straight line. Then, both ends of the aluminum substrate on the outer peripheral surface side are chamfered by using a cutting tool in the entire circumferential direction such that the chamfer angle a and the chamfer width b are set as indicated in Table 1, and the slope shape of the chamfer portion is a straight line, and an end surface has the end surface width c as indicated in Table 1.

Preparation of Photoreceptors 1 to 73

The undercoat layer, the charge generation layer, and the charge transport layer are formed on each of conductive supports 1 to 73 in accordance with the following steps.

Forming Undercoat Layer 100 parts by weight of zinc oxide (average particle size of 70 nm, specific surface area of 15 $m^2/g$, manufactured by TAYACA CORPORATION)) and 500 parts by weight of toluene are stirred and mixed with each other, 1.3 parts by weight of silane coupling agent (product name: KBM603, manufactured by Shin-Etsu Chemical Co., Ltd., N-2-(aminoethyl)-3-aminopropyl trimethoxy silane) is added thereto, and the mixture is stirred for two hours. Then, zinc oxide is obtained by distilling off the toluene under reduced pressure, sintering the distilled toluene at 120° C. for three hours, and then performing a surface treatment by using a silane coupling agent.

110 parts by weight of zinc oxide on which the surface treatment is performed and 500 parts by weight of tetrahydrofuran are stirred and mixed with each other, a solution in which 0.6 parts by weight of alizarin is dissolved into 50 parts by weight tetrahydrofuran is added to the mixture and stirred at 50° C. for five hours. Then, a solid is filtered off under reduced pressure filtration, and dried under reduced pressure at 60° C. so as to obtain alizarin-added zinc oxide.

60 parts by weight of the alizarin-added zinc oxide, 13.5 parts by weight of curing agent (blocked isocyanate SUMIDUR 3173, manufactured by Sumitomo-Bayer Urethane Co., Ltd.), 15 parts by weight of butyral resin (S-LEC BM-1, manufactured by Sekisui Chemical Co., Ltd.), and 68 parts by weight of methyl ethyl ketone are mixed with each other so as to obtain a mixture. 100 parts by weight of the obtained mixture is mixed with 5 parts by weight of methyl ethyl ketone, and the mixture is dispersed for 2 hours using a sand mill with 1 mmϕ glass beads so as to obtain dispersion. To this dispersion, as a catalyst, 0.005 parts by weight of dioctyl tin dilaurate and 4 parts by weight of silicone resin particles (TOSPEARL 145, manufactured by Momentive Performance Materials Inc.) are added so as to obtain a coating liquid for forming an undercoat layer.

The conductive support is dipped into the coating liquid for forming an undercoat layer in the longitudinal direction which is set as the gravity direction, and is picked up. Then, the coated film is dried at ambient temperature of 170° C. for 40 minutes in a state in which the longitudinal direction is still set as the gravity direction, thereby obtaining an undercoat layer having a thickness of 22 μm.

Forming Charge Generation Layer 15 parts by weight of hydroxygallium phthalocyanine, as the charge generation material (having diffraction peaks at Bragg angles (2θ±0.2°) of at least 7.5°, 9.9°, 12.5°, 16.3°, 18.6°, 25.1°, and 28.3° in an X-ray diffraction spectrum using CuKα characteristic X-ray), a mixture, in which 10 parts by weight of vinyl chloride-vinyl acetate copolymer resin (VMCH, manufactured by Nippon Unicar Co., Ltd.) as the binder resin, and 200 parts by weight of n-butyl acetate are mixed with each other, and is dispersed using a sand mill with glass beads having a diameter of 1 mmϕ for 4 hours.

175 parts by weight of n-butyl acetate and 180 parts by weight of methyl ethyl ketone are added to the obtained dispersion, followed by stirring so as to obtain a coating liquid for forming a charge generation layer.

The conductive support including the undercoat layer is dipped into the coating liquid forming a charge generation layer in the longitudinal direction which is set as the gravity direction, and is picked up. Then, the coated film is dried at ambient temperature of 100° C. for 8 minutes in a state in which the longitudinal direction is still set as the gravity direction, thereby obtaining a charge generation layer having a thickness of 0.15 μm.

Forming Charge Transport Layer 8 parts by weight of butane charge transport material represented by the following formula (CT1A) and 32 parts by weight of benzidine charge transport material represented by the following formula (CT2A) as the charge transport material, 58 parts by weight of bisphenol Z-type polycarbonate resin (a homopolymer of bisphenol Z, viscosity-average molecular weight of 40,000) as a binder resin, and 2 parts by weight of hindered phenol antioxidant represented by the following formula (HP-1) as antioxidant are dissolved in 340 parts by weight of tetrahydrofuran. As a result, the coating liquid for forming a charge transport layer is obtained.

25 minutes is a state in which the longitudinal direction is still set as the gravity direction, thereby obtaining a charge transport layer having a thickness of 25 μm.

The photoreceptors 1 to 73 including any one of the conductive supports 1 to 73 are obtained through the above-described steps.

Evaluation of Photoreceptor

Sensitivity Unevenness

Under the temperature of 20° C. and the relative humidity of 40%, in a state where the photoreceptor is rotated 100 times per minute, the photoreceptor is charged to be −700 V by using a scorotron charging device, and then discharged by the irradiation of the light of 2 mJ/m$^2$ by using semiconductor laser having a wavelength of 780 nm after 115 milliseconds from the charging. The potential (unit: V) of the surface of the photoreceptor after 50 milliseconds from the charging is measured, and the measured value is set as a value of a post irradiation potential VL. The post irradiation potential VL is measured at 1548 points, in total, of 43 points at a pitch of 5 mm in a range of from 20 mm to 230 mm from one end of the photoreceptor, and 36 points in the circumferential direction at a pitch of 10°. A difference Δ VL (unit: V) between the maximum VL and the minimum VL is calculated and the values are classified as follows. The results are indicated in Tables 1 to 3.

(CT1A)

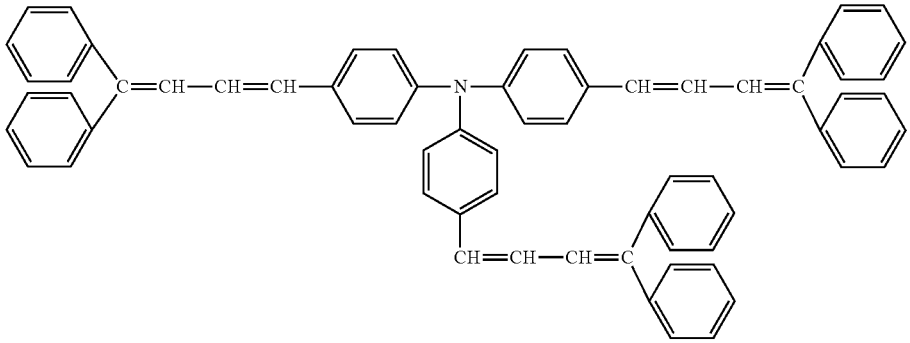

(CT2A)

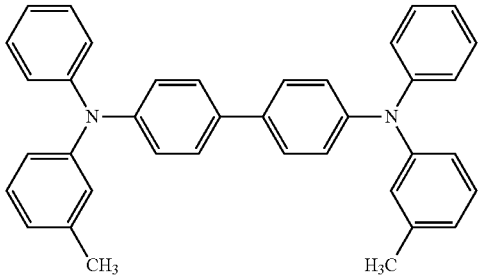

(HP-1)

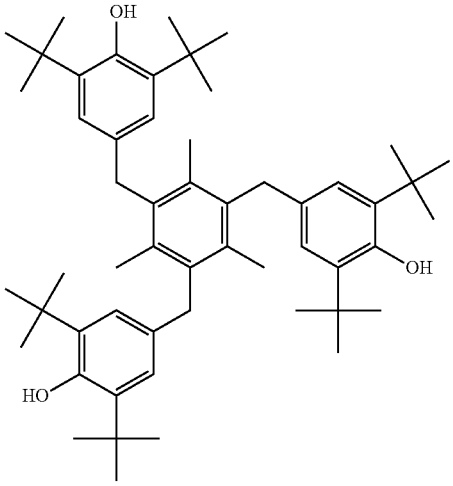

Figure 6:
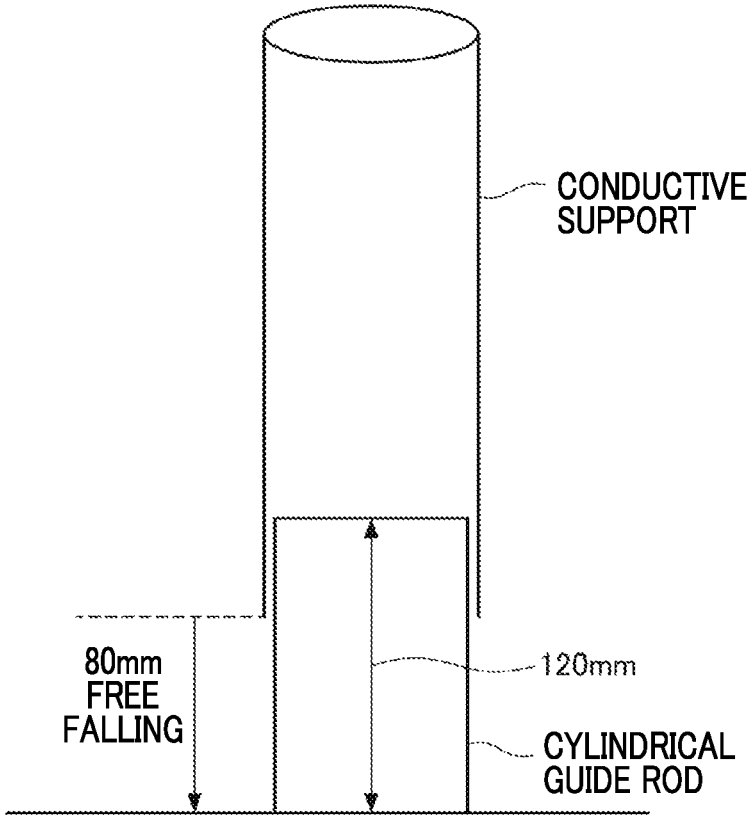
FIG. 6 is a schematic configuration diagram of a cylindrical guide rod used for evaluating the strength of an end surface of the conductive support.

The conductive support including the undercoat layer and the charge generation layer is dipped into the coating liquid forming a charge transport layer in the longitudinal direction which is set as the gravity direction, and is picked up. Then, the coated film is dried at ambient temperature of 143° C. for G1:Δ VL<15 V, no practical problem G2:15 V≤Δ VL<20 V, no practical problem G3:20 V≤Δ VL<25 V, problems may occur on fine line reproducibility or gradation properties G4:25 V≤Δ VL, practical problem occurs Strength of end surface of conductive support The cylindrical guide rod illustrated in FIG. 6 allows the conductive support (a tube material before forming a photosensitive layer) to freely fall from the height of 80 mm five times so as to collide with a steel horizontal stand. The lower end surface of the conductive support is visually observed, and the observation is classified as follows. The results are indicated in Tables 1 to 3.

G1: No deformation is observed on the lower end surface.

G2: Although deformation is observed on the lower end surface, a member for mounting the photoreceptor to the image forming apparatus may be installed at an end portion of the conductive support, the photoreceptor variation accuracy after the installment is acceptable in the deformation range, and thus it is possible to be used for the photoreceptor.

G3: Deformation is observed on the lower end surface, a member for mounting the photoreceptor to the image forming apparatus may not be installed at an end portion of the conductive support, or even if the member is able to be installed, the photoreceptor variation accuracy after the installment is greatly affected by the deformation, and thus it is not possible to be used for the photoreceptor.

TABLE 1

| Conductive support | Photoreceptor | Thickness t [mm] | Chamfer portion on outer peripheral surface side a [degree] | b [mm] | End surface width c [mm] | Sensitivity unevenness Δ VL | Classification | Deformation at end portion | Remarks |
|---|---|---|---|---|---|---|---|---|---|
| 1 | 1 | 0.5 | 30 | 0.05 | 0.35 | 32 | G4 | G1 | Comparative Example |
| 2 | 2 | 0.5 | 30 | 0.10 | 0.30 | 30 | G4 | G1 | Comparative Example |
| 3 | 3 | 0.5 | 30 | 0.20 | 0.20 | 29 | G4 | G1 | Comparative Example |
| 4 | 4 | 0.5 | 30 | 0.30 | 0.10 | 26 | G4 | G2 | Comparative Example |
| 5 | 5 | 0.5 | 28 | 0.03 | 0.37 | 26 | G4 | G1 | Comparative Example |
| 6 | 6 | 0.5 | 28 | 0.05 | 0.35 | 20 | G3 | G1 | Example |
| 7 | 7 | 0.5 | 28 | 0.10 | 0.30 | 19 | G2 | G1 | Example |
| 8 | 8 | 0.5 | 28 | 0.20 | 0.20 | 17 | G2 | G1 | Example |
| 9 | 9 | 0.5 | 28 | 0.30 | 0.10 | 16 | G2 | G2 | Example |
| 10 | 10 | 0.5 | 28 | 0.32 | 0.08 | 14 | G1 | G3 | Comparative Example |
| 11 | 11 | 0.5 | 20 | 0.03 | 0.37 | 26 | G4 | G1 | Comparative Example |
| 12 | 12 | 0.5 | 20 | 0.05 | 0.35 | 20 | G3 | G1 | Example |
| 13 | 13 | 0.5 | 20 | 0.10 | 0.30 | 15 | G2 | G1 | Example |
| 14 | 14 | 0.5 | 20 | 0.20 | 0.20 | 12 | G1 | G1 | Example |
| 15 | 15 | 0.5 | 20 | 0.30 | 0.10 | 9 | G1 | G2 | Example |
| 16 | 16 | 0.5 | 20 | 0.32 | 0.08 | 9 | G1 | G3 | Comparative Example |
| 17 | 17 | 0.5 | 10 | 0.03 | 0.37 | 27 | G4 | G1 | Comparative Example |
| 18 | 18 | 0.5 | 10 | 0.05 | 0.35 | 21 | G3 | G1 | Example |
| 19 | 19 | 0.5 | 10 | 0.10 | 0.30 | 16 | G2 | G1 | Example |
| 20 | 20 | 0.5 | 10 | 0.20 | 0.20 | 13 | G1 | G1 | Example |
| 21 | 21 | 0.5 | 10 | 0.30 | 0.10 | 10 | G1 | G2 | Example |
| 22 | 22 | 0.5 | 10 | 0.32 | 0.08 | 10 | G1 | G3 | Comparative Example |
| 23 | 23 | 0.5 | 8 | 0.05 | 0.35 | 29 | G4 | G1 | Comparative Example |
| 24 | 24 | 0.5 | 8 | 0.10 | 0.30 | 27 | G4 | G1 | Comparative Example |
| 25 | 25 | 0.5 | 8 | 0.20 | 0.20 | 27 | G4 | G1 | Comparative Example |
| 26 | 26 | 0.5 | 8 | 0.30 | 0.10 | 25 | G4 | G2 | Comparative Example |

TABLE 2

| Conductive support | Photoreceptor | Thickness t [mm] | Chamfer portion on outer peripheral surface side a [degree] | b [mm] | End surface width c [mm] | Sensitivity unevenness Δ VL | Classification | Deformation at end portion | Remarks |
|---|---|---|---|---|---|---|---|---|---|
| 27 | 27 | 0.4 | 30 | 0.05 | 0.25 | 34 | G4 | G1 | Comparative Example |
| 28 | 28 | 0.4 | 30 | 0.10 | 0.20 | 31 | G4 | G1 | Comparative Example |
| 29 | 29 | 0.4 | 30 | 0.15 | 0.15 | 29 | G4 | G1 | Comparative Example |
| 30 | 30 | 0.4 | 30 | 0.20 | 0.10 | 28 | G4 | G2 | Comparative Example |
| 31 | 31 | 0.4 | 28 | 0.03 | 0.27 | 27 | G4 | G1 | Comparative Example |
| 32 | 32 | 0.4 | 28 | 0.05 | 0.25 | 21 | G3 | G1 | Example |
| 33 | 33 | 0.4 | 28 | 0.10 | 0.20 | 20 | G3 | G1 | Example |
| 34 | 34 | 0.4 | 28 | 0.15 | 0.15 | 17 | G2 | G1 | Example |
| 35 | 35 | 0.4 | 28 | 0.20 | 0.10 | 15 | G2 | G2 | Example |
| 36 | 36 | 0.4 | 28 | 0.22 | 0.08 | 14 | G1 | G3 | Comparative Example |
| 37 | 37 | 0.4 | 20 | 0.03 | 0.27 | 26 | G4 | G1 | Comparative Example |
| 38 | 38 | 0.4 | 20 | 0.05 | 0.25 | 21 | G3 | G1 | Example |
| 39 | 39 | 0.4 | 20 | 0.10 | 0.20 | 16 | G2 | G1 | Example |
| 40 | 40 | 0.4 | 20 | 0.15 | 0.15 | 12 | G1 | G1 | Example |
| 41 | 41 | 0.4 | 20 | 0.20 | 0.10 | 10 | G1 | G2 | Example |
| 42 | 42 | 0.4 | 20 | 0.22 | 0.08 | 9 | G1 | G3 | Comparative Example |
| 43 | 43 | 0.4 | 10 | 0.03 | 0.27 | 30 | G4 | G1 | Comparative Example |
| 44 | 44 | 0.4 | 10 | 0.05 | 0.25 | 23 | G3 | G1 | Example |
| 45 | 45 | 0.4 | 10 | 0.10 | 0.20 | 18 | G2 | G1 | Example |
| 46 | 46 | 0.4 | 10 | 0.15 | 0.15 | 16 | G2 | G1 | Example |
| 47 | 47 | 0.4 | 10 | 0.20 | 0.10 | 13 | G1 | G2 | Example |
| 48 | 48 | 0.4 | 10 | 0.22 | 0.08 | 11 | G1 | G3 | Comparative Example |

TABLE 2-continued

| Conductive support | Photoreceptor | Thickness t [mm] | Chamfer portion on outer peripheral surface side a [degree] | b [mm] | End surface width c [mm] | Sensitivity unevenness Δ VL | Classification | Deformation at end portion | Remarks |
|---|---|---|---|---|---|---|---|---|---|
| 49 | 49 | 0.4 | 8 | 0.05 | 0.25 | 31 | G4 | G1 | Comparative Example |
| 50 | 50 | 0.4 | 8 | 0.10 | 0.20 | 29 | G4 | G1 | Comparative Example |
| 51 | 51 | 0.4 | 8 | 0.15 | 0.15 | 27 | G4 | G1 | Comparative Example |
| 52 | 52 | 0.4 | 8 | 0.20 | 0.10 | 25 | G4 | G2 | Comparative Example |

TABLE 3

| Conductive support | Photoreceptor | Thickness t [mm] | Chamfer portion on outer peripheral surface side a [degree] | b [mm] | End surface width c [mm] | Sensitivity unevenness Δ VL | Classification | Deformation at end portion | Remarks |
|---|---|---|---|---|---|---|---|---|---|
| 53 | 53 | 0.3 | 30 | 0.05 | 0.15 | 35 | G4 | G1 | Comparative Example |
| 54 | 54 | 0.3 | 30 | 0.10 | 0.10 | 32 | G4 | G2 | Comparative Example |
| 55 | 55 | 0.3 | 28 | 0.03 | 0.17 | 29 | G4 | G1 | Comparative Example |
| 56 | 56 | 0.3 | 28 | 0.05 | 0.15 | 23 | G3 | G1 | Example |
| 57 | 57 | 0.3 | 28 | 0.10 | 0.10 | 22 | G3 | G2 | Example |
| 58 | 58 | 0.3 | 28 | 0.12 | 0.08 | 20 | G3 | G3 | Comparative Example |
| 59 | 59 | 0.3 | 20 | 0.03 | 0.17 | 28 | G4 | G1 | Comparative Example |
| 60 | 60 | 0.3 | 20 | 0.05 | 0.15 | 22 | G3 | G1 | Example |
| 61 | 61 | 0.3 | 20 | 0.10 | 0.10 | 18 | G2 | G2 | Example |
| 62 | 62 | 0.3 | 20 | 0.12 | 0.08 | 15 | G2 | G3 | Comparative Example |
| 63 | 63 | 0.3 | 10 | 0.03 | 0.17 | 27 | G4 | G1 | Comparative Example |
| 64 | 64 | 0.3 | 10 | 0.05 | 0.15 | 23 | G3 | G1 | Example |
| 65 | 65 | 0.3 | 10 | 0.10 | 0.10 | 22 | G3 | G2 | Example |
| 66 | 66 | 0.3 | 10 | 0.12 | 0.08 | 18 | G2 | G3 | Comparative Example |
| 67 | 67 | 0.3 | 8 | 0.05 | 0.15 | 33 | G4 | G1 | Comparative Example |
| 68 | 68 | 0.3 | 8 | 0.10 | 0.10 | 30 | G4 | G2 | Comparative Example |
| 69 | 69 | 0.25 | 30 | 0.05 | 0.10 | 35 | G4 | G2 | Comparative Example |
| 70 | 70 | 0.25 | 28 | 0.05 | 0.10 | 24 | G3 | G2 | Example |
| 71 | 71 | 0.25 | 20 | 0.05 | 0.10 | 23 | G3 | G2 | Example |
| 72 | 72 | 0.25 | 10 | 0.05 | 0.10 | 23 | G3 | G2 | Example |
| 73 | 73 | 0.25 | 8 | 0.05 | 0.10 | 34 | G4 | G2 | Comparative Example |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive support which is formed of a bottomless hollow cylindrical member being made of metal and having a thickness t of equal to or less than 0.4 mm, wherein the conductive support comprises:

a chamfer portion on an outer peripheral surface side of at least one end of the conductive support over an entire circumferential direction, wherein the chamfer portion has a chamfer angle a of equal to or greater than 10° and equal to or less than 20° with respect to the outer peripheral surface, and a chamfer width b of equal to or greater than 0.05 mm in an end surface, and wherein the conductive support has an end surface width c is equal to or greater than 0.1 mm in the end surface including the chamfer portion.

2. The conductive support according to claim 1, wherein the end surface width c is equal to or less than 0.3 mm.

3. An electrophotographic photoreceptor comprising:

a conductive support which is formed of a bottomless hollow cylindrical member being made of metal and having a thickness t of equal to or less than 0.4 mm, wherein the conductive support comprises:

a chamfer portion on the outer peripheral surface side of at least one end of the conductive support over the entire circumferential direction, wherein the chamfer portion has a chamfer angle a of equal to or greater than 10° and equal to or less than 20° with respect to the outer peripheral surface, and a chamfer width b of equal to or greater than 0.05 mm in an end surface, and wherein the conductive support has an end surface width c is equal to or greater than 0.1 mm in the end surface including the chamfer portion; and a photosensitive layer disposed on the conductive support.

4. The electrophotographic photoreceptor according to claim 3, wherein the end surface width c is equal to or less than 0.3 mm.

5. A process cartridge which is detachable from an image forming apparatus, the cartridge comprising:

an electrophotographic photoreceptor including:

a conductive support which is formed of a bottomless hollow cylindrical member being made of metal and having a thickness t of equal to or less than 0.4 mm, wherein the conductive support comprises:

a chamfer portion on the outer peripheral surface side of at least one end over the entire circumferential direction, wherein the chamfer portion has a chamfer angle a of equal to or greater than 10° and equal to or less than 20° with respect to the outer peripheral surface, and a chamfer width b of equal to or greater than 0.05 mm in an end surface, and wherein the conductive support has an end surface width c is equal to or greater than 0.1 mm in the end surface including the chamfer portion; and a photosensitive layer disposed on the conductive support.

6. The process cartridge according to claim 5, wherein the end surface width c is equal to or less than 0.3 mm.

* * * * *